US005823792A

United States Patent [19]

Regnier

[11] Patent Number: 5,823,792

[45] Date of Patent: Oct. 20, 1998

[54] WIRE-WRAP CONNECTOR

[75] Inventor: Kent E. Regnier, Lombard, Ill.

[73] Assignee: Molex Incorporated, Lisle, Ill.

[21] Appl. No.: 814,307

[22] Filed: Mar. 10, 1997

[51] Int. Cl.[6] ..... H01R 9/09

[52] U.S. Cl. ..... 439/66; 29/825

[58] Field of Search ..... 439/66, 91, 591, 439/71; 29/825, 837

[56] References Cited

U.S. PATENT DOCUMENTS

| | | | |
|---|---|---|---|
| 3,795,884 | 3/1974 | Kotaka | 439/591 |
| 3,851,297 | 11/1974 | Munro | 439/591 |
| 3,951,493 | 4/1976 | Kozel et al. | 439/591 |
| 4,647,124 | 3/1987 | Kandybowski | 339/17 CF |
| 4,699,593 | 10/1987 | Grabbe et al. | 439/71 |
| 4,906,194 | 3/1990 | Grabbe | 439/71 |
| 4,969,826 | 11/1990 | Grabbe | 439/66 |
| 5,019,945 | 5/1991 | Smolley | 361/412 |
| 5,071,359 | 12/1991 | Arnio et al. | 439/91 |
| 5,199,889 | 4/1993 | McDevitt, Jr. | 439/66 |
| 5,302,853 | 4/1994 | Volz et al. | 257/707 |
| 5,474,458 | 12/1995 | Vafi et al. | 439/91 |
| 5,632,626 | 5/1997 | Collins et al. | 439/591 |

OTHER PUBLICATIONS

Rod–Shaped Connector, IBM Technical Disclosure Bulletin vol. 33 No. 9, Feb. 1991.

*Primary Examiner*—Gary F. Paumen
*Assistant Examiner*—Tho D. Ta
*Attorney, Agent, or Firm*—Charles S. Cohen

[57] ABSTRACT

A connector for connecting first and second electronic components, the components each having an array of contact pads. The connector comprises a dielectric housing having substantially planar top and bottom surfaces and sidewalls connecting the top and bottom surfaces as well as a plurality of substantially open receptacles in the housing. A plurality of contact members individually disposed in distinct ones of the plurality of receptacles. The contact members extending above the top surface and below the bottom surface to contact respective ones of the contact pads of the first and second circuit components. The contact members comprise an elastomeric dielectric core, a first electrically conductive wire wrapped around the core in a first direction, and may include a second electrically conductive wire wrapped around the core and the first wire in a second direction with the second wire contacting the first wire at a plurality of wire contact points to provide electrical connection between the first and second wires.

20 Claims, 4 Drawing Sheets

WIRE-WRAP CONNECTOR

BACKGROUND OF THE INVENTION

This invention relates to electrical connectors, and more particularly, to land grid array connectors for connecting together a pair of electronic components having contact pad-type terminals.

Due to technological development, electronic components have generally become smaller, denser, and more efficient in recent years, but such size reductions have presented challenges in physically and electrically connecting them to one another. Technological development in the area of electrical connectors for such electronic components has lagged somewhat the development of the components themselves.

Among other changes that have taken place, it has become desirable to provide components with much shorter terminals than the pins typically found in traditional pin grid arrays. In order to permit higher operating speeds, the trend has been to shorten connection paths. One form of terminal which has been found to be effective in avoiding some of the cost, bending, density, impedance, and operating speed problems inherent in longer pin-type terminals is the contact pad. Contact pads are leadless, electrically conductive bump-like protrusions from, or flat surfaces on, the surface of an electronic component. Contact pads are typically aligned into a rectangular grid or array on the surface of a component, forming what is known as a land grid array.

Electrical connectors have been provided to connect contact pads from one component to appropriately aligned contact pads from a second component. It has proven difficult, however, particularly in view of the size reductions, to design connectors capable of simultaneously connecting a large number of aligned contact pads to permit a range of signals to be transmitted therebetween.

In particular, it is desirable to maintain a high pressure contact between each aligned pair of contact pads so that the signals may be clearly transmitted and any oxidation or film on the terminals is substantially overcome. However, it is not desirable for land grid array connectors to require a large total mating assembly force, such total being equal to the sum of the individual contact forces. Given the high circuit densities which have accompanied the reductions in size of the electrical components, intolerably high total mating forces may be required if the individual contact forces required are too high.

Another problem connector manufacturers have faced with the continuing size reduction of electrical components is providing contacts with sufficient conductivity to handle larger electrical currents, such as those associated with power signals. Generally, conductive contact elements with greater cross-sectional area facilitate smaller power loss and decrease the occurrence of contact element failure, but reduced component sizes have made it difficult to incorporate contacts with large conductivities.

Efforts to address some of the above-described difficulties have included changes to the particular shape of the contact elements within land grid array connectors, such as by creating spherical or S-shaped contact elements, "fuzz button" contact elements, or spring-type contact elements. Other efforts to improve land grid array connectors have involved employing a particular modular arrangement of contact elements, slot-and-key or support frame structures for holding a component in a desired position, or metal plated apertures or vias for conducting electrical current. However, none of these efforts has been entirely successful in addressing all the functional requirements of such connectors.

SUMMARY OF THE INVENTION

To address the problems presented above, the inventive connector reliably connects a pair of electronic components having land grid arrays. Furthermore, the inventive connector has contact elements capable of providing high pressure contacts and carrying signals without substantial energy dissipation.

The inventive connector connects first and second electronic components, the components each having an array of contact pads. The connector comprises a dielectric housing having substantially planar top and bottom surfaces and sidewalls connecting the top and bottom surfaces, a plurality of substantially open receptacles in the housing, and a plurality of contact members individually disposed in distinct ones of the plurality of receptacles. The contact members extend above the top surface and below the bottom surface to contact respective ones of the contact pads of the first and second circuit components. The contact members may comprise an elastomeric dielectric core, a first electrically conductive wire wrapped around the core in a first direction, and a second electrically conductive wire wrapped around the core and the first wire in a second direction with the second wire contacting the first wire at a plurality of wire contact points to provide electrical connection between the first and second wires.

The invention also includes a contact appropriate for use in the described electrical connector. The contact is for electrically connecting a contact pad of a first circuit to a contact pad of a second circuit. The contact comprises a dielectric core of elastomeric material to be compressed between the contact pads, a first electrically conductive wire wrapped around the core in a first direction for providing an electrical path around the core, and a second electrically conductive wire wrapped around the core and the first wire in a second direction, the second wire making intersecting contact with the first wire at a plurality of wire contact points.

Finally, the invention also includes a process for making the inventive electrical connector. The inventive process comprises the steps of providing a resilient dielectric housing having substantially planar top and bottom surfaces and sidewalls, the housing having a plurality of substantially open receptacles having contact retainers disposed therein. An elastomeric bobbin is provided and a first electrically conductive wire is wrapped around the bobbin in a first direction. A second electrically conductive wire is then wrapped around the bobbin in a second direction with the second wire contacting the first wire at a plurality of wire contact points to provide electrical connection between the first and second wires. The steps of providing a bobbin and wrapping two wires around it are then repeated until a predetermined number of wire-wrapped bobbins have been assembled. A plurality of wire-wrapped bobbins are then inserted into the receptacles so as to be substantially held within the receptacles by the contact retainers.

The inventive connector permits reliable, high pressure, small area contacts which reduce the total force required to mate electronic components. Furthermore, multiple pathways and high conductivity are provided in the contact elements, thereby accommodating larger signals and minimizing power loss therein.

DETAILED DESCRIPTION OF THE PREFERRED EMBODIMENT

The present invention is a connector for electrically connecting a first electronic component having an array of contact pad terminals on a surface of the first electronic component and a second electronic component having a similar array of contact pad terminals on a surface of the second electronic component. The preferred embodiment of the invention is described herein below and seen in the accompanying drawings FIGS. 1–6.

Figure 1:
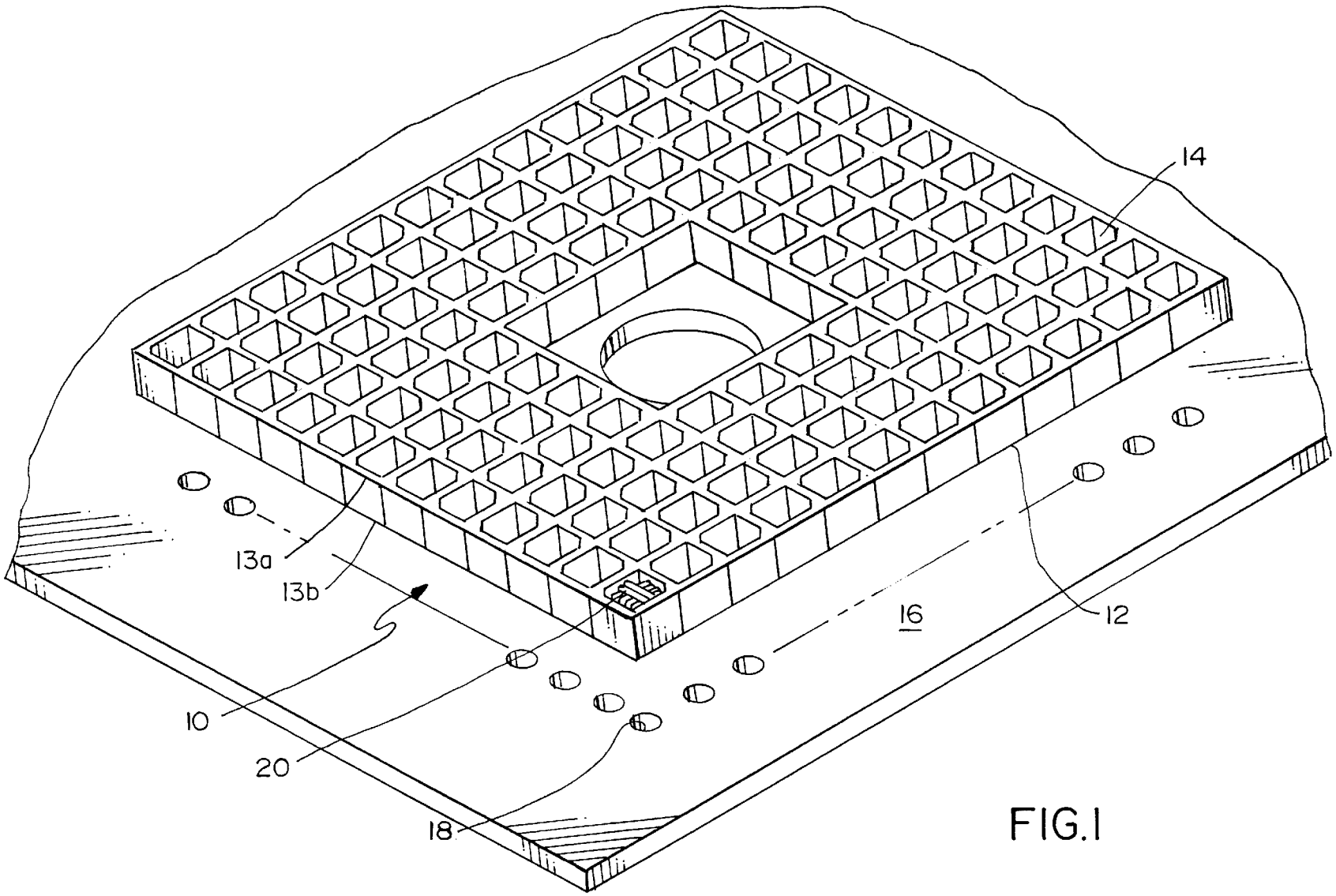
FIG. 1 is a perspective view of an electrical connector in accordance with a preferred embodiment of the invention.

FIG. 1 illustrates the relative placement of the preferred embodiment of the electrical connector 10 with respect to an electronic component 16, such as a motherboard, having an array of contact pads 18. The contact pads 18 serve as terminals to the electronic component 16 and the connector 10 is interposed between to such electronic components, only one of which is shown. FIG. 1 shows the connector 10 slightly elevated above the component 16 in order to more clearly show the contact pads 18; in operation the connector 10 would substantially abut the component 16 and be sandwiched by a second component.

The electrical connector 10 comprises a dielectric housing 12 having a plurality of substantially open receptacles 14 therein. When the connector 10 is properly disposed between the electronic components, the receptacles 14 substantially align between corresponding contact pads 18 of the components. Preferably, the two components have identical arrays of contact pads, and these arrays preferably correspond to the receptacles of the housing.

The dielectric housing 12 has a top surface 13*a* and a bottom surface 13*b*. The top surface 13*a* substantially abuts a first electronic component and the bottom surface 13*b* substantially abuts a second electronic component. The housing 12 is shown as a standard 128 receptacle type spacer housing having a square 12×12 array of receptacles with a central 4×4 portion removed. Housings of different sizes and receptacle configurations are contemplated by the invention but the housing shown is contemplated to be 12.0 mm by 12.0 mm by 0.8 mm.

Figure 2:
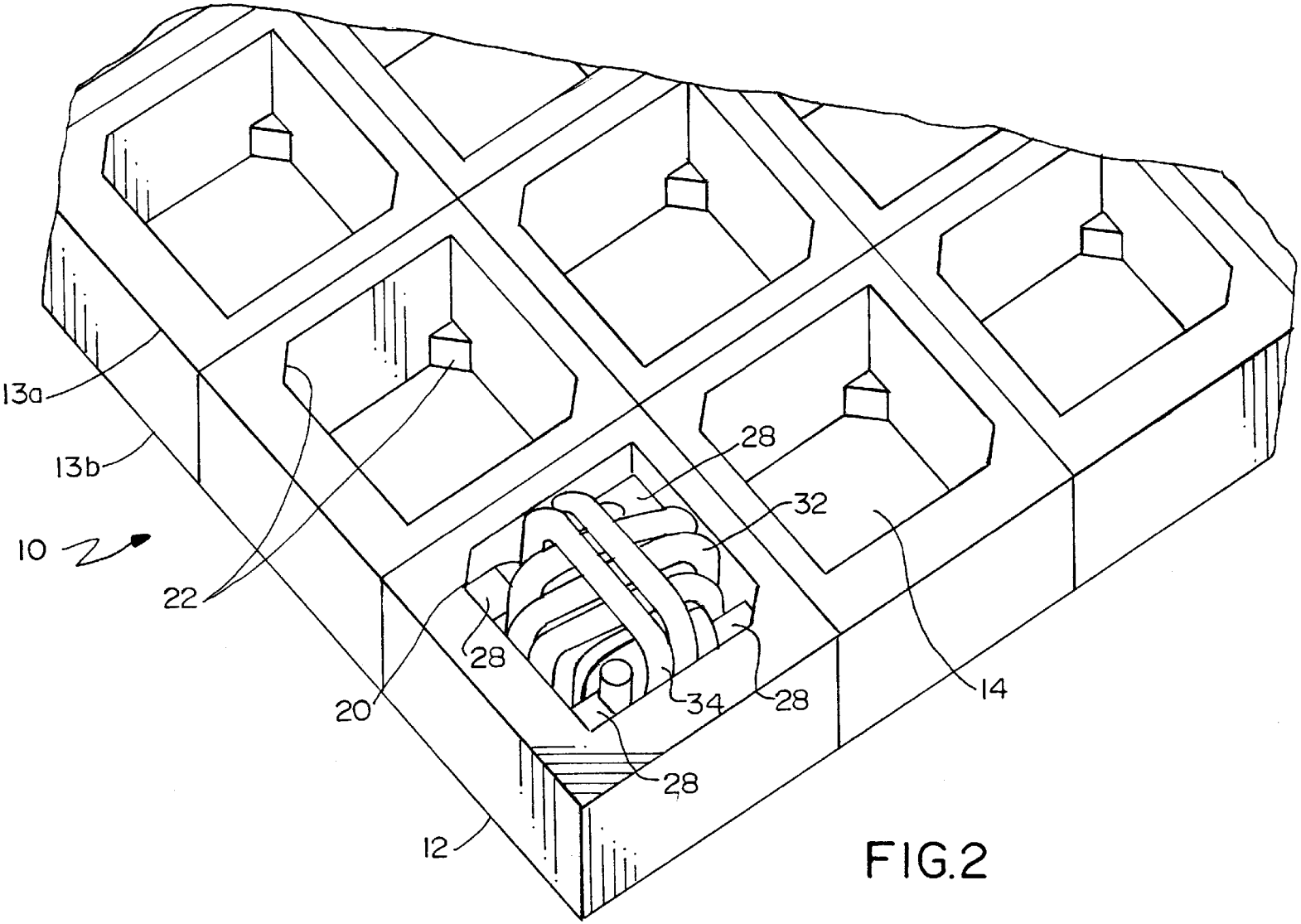
FIG. 2 is a perspective view of a portion of the connector of FIG. 1 shown in more detail.

As seen in more detail in FIG. 2, a contact element 20 is disposed within one or more receptacles 14 within the housing 12. The contact elements 20 are substantially retained within the receptacles 14 by contact retainers 22. The contact retainers 22 may take a variety of forms, but preferably are triangular fillets integrally formed with the housing 12. The fillets preferably occupy opposite corners of the receptacle at both the top and bottom surfaces of the housing 12. In other words, since each receptacle 14 is generally rectangular, it has four corners adjacent the top surface 13*a* of the housing 12 and four corners adjacent the bottom surface 13*b*. Each receptacle includes four of the pillet-shaped contact retainers 22 with two being located adjacent the top surface 13*a* of the housing and two being located adjacent the bottom surface 13*b*. The contact retainers 22 adjacent the top surface are located at diagonally opposite corners of the receptacle and the retainers 22 adjacent the bottom surface are also located at diagonally opposite corners but rotated 90° relative to the retainers adjacent the top surface 13*a*.

Figure 3:
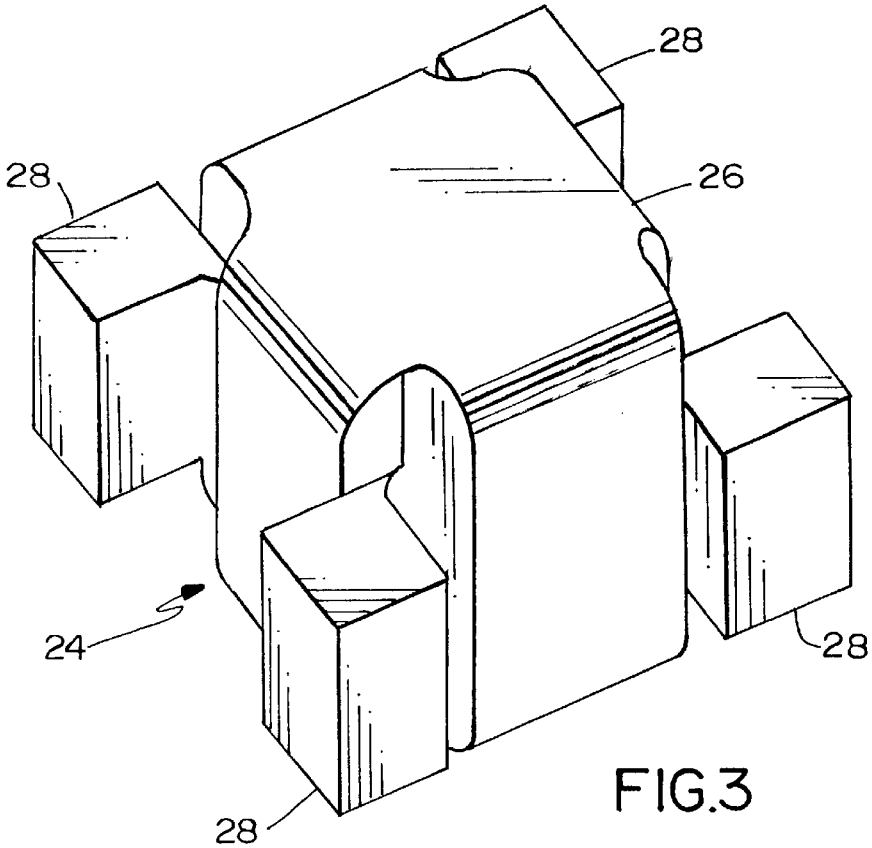
FIG. 3 is a perspective view of an elastomeric core in accordance with a preferred embodiment of the invention.
Figure 4:
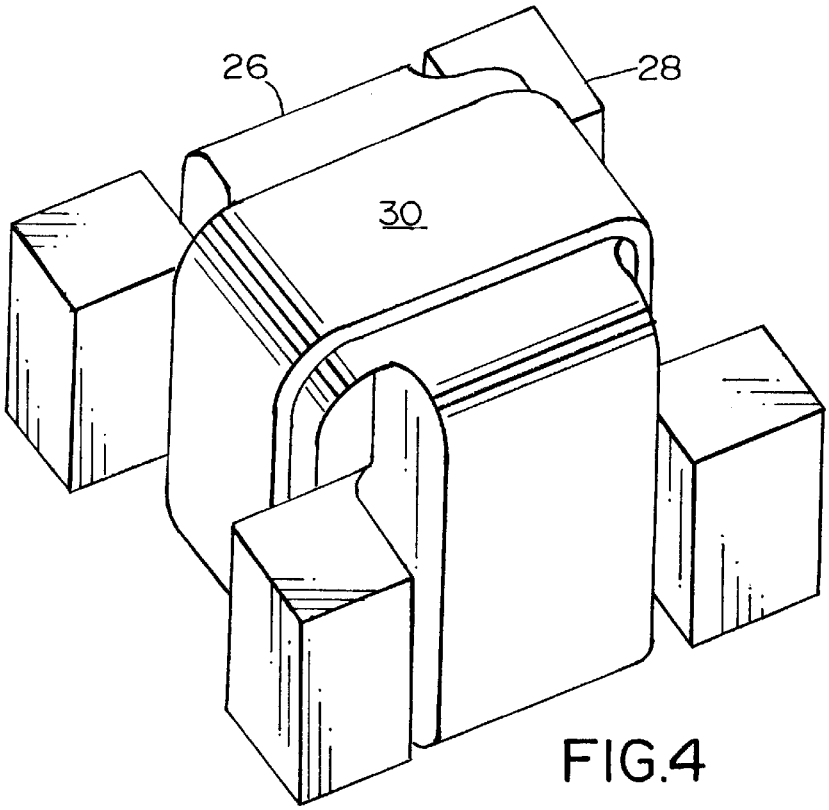
FIG. 4 is a perspective view of the elastomeric core of FIG. 3 with a foil wrapped around the core in accordance with a preferred embodiment of the invention.
Figure 5:
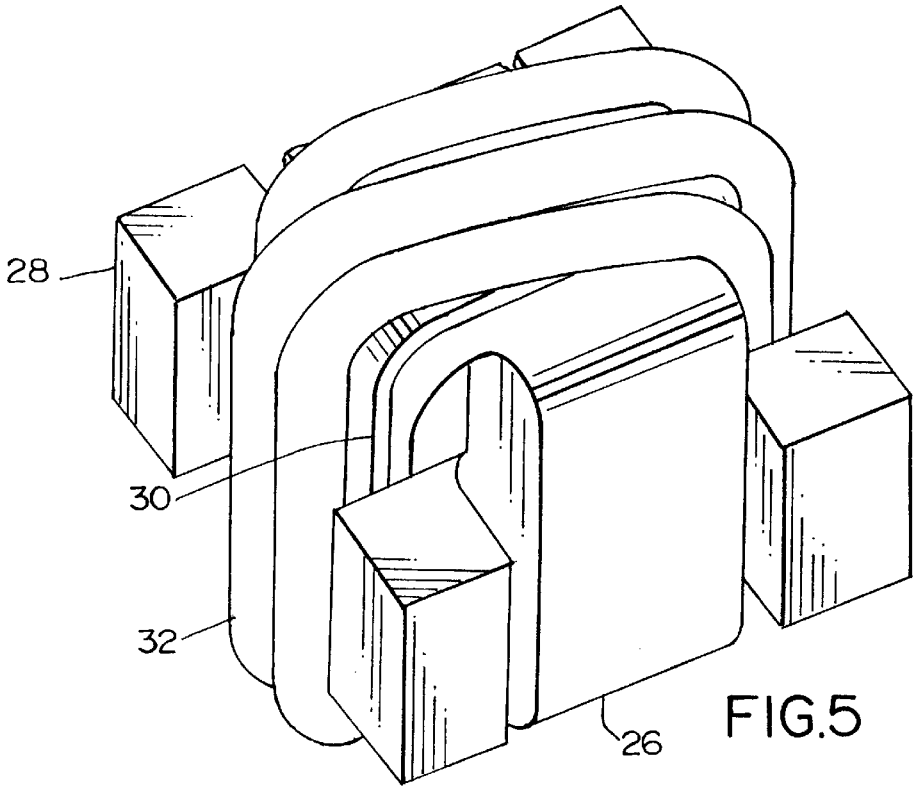
FIG. 5 is a perspective view of the elastomeric core and foil of FIG. 4 with a first wire wrapped around the core and foil in accordance with a preferred embodiment of the invention.
Figure 6:
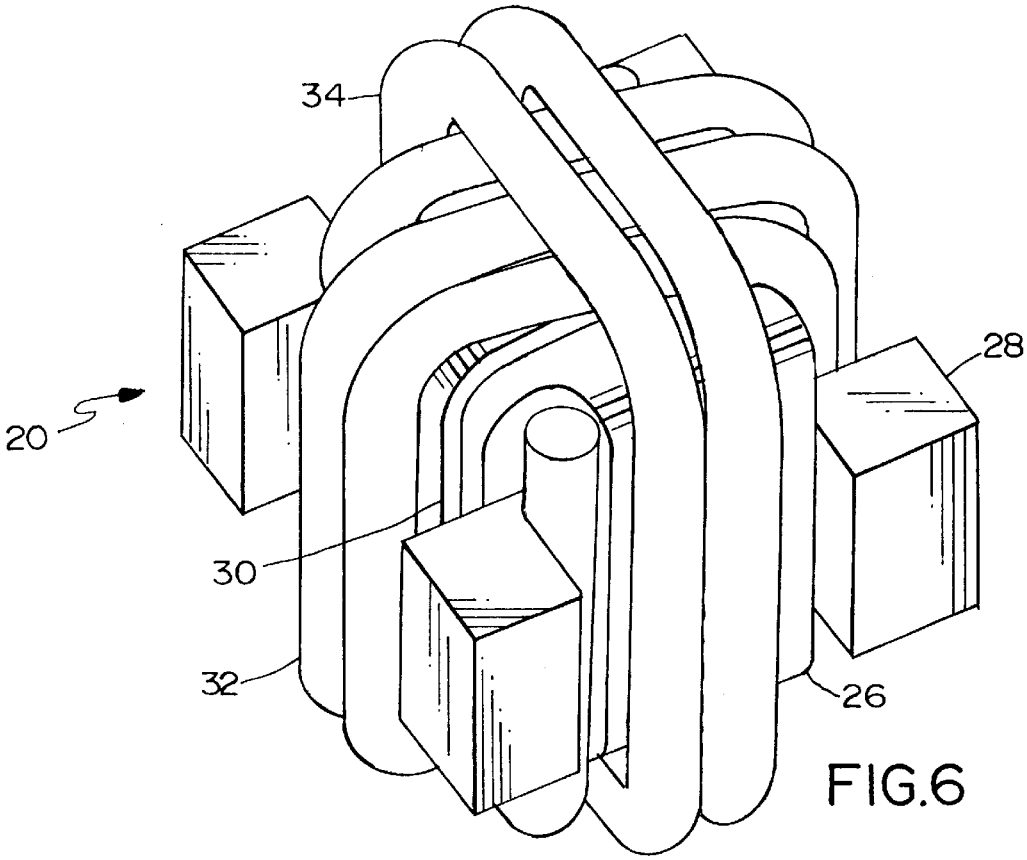
FIG. 6 is a perspective view of the elastomeric core, foil, and first wire of FIG. 5 with a second wire wrapped around the core, foil, and first wire in accordance with a preferred embodiment of the invention.

The preferred embodiment of the contact element 20 comprises an elastomeric dielectric bobbin 24, as seen in FIG. 3, having a relatively larger generally rectangular central portion 26 and four relatively smaller generally rectangular winged portions 28. Each of the winged portions preferably have mutually substantially parallel axes. The elastomeric bobbin 24 serves as the core of the contact element and may be made from any resilient elastomeric material. Preferably, the bobbin 24 is approximately 0.8 mm by 0.8 mm by 0.8 mm. The bobbin 24 provides the contact element 20 with internal resiliency to facilitate maintaining a high pressure contact between the compressed contact element 20 and the contact pads 18 on the electronic components. As shown in FIG. 4, an electrically conductive flat foil 30 is preferably wrapped around the central portion 26 of the contact element 20. FIG. 5 illustrates how a first electrically conductive wire 32 substantially overwraps in parallel direction the conductive foil 30 and the central portion 26 of the elastomeric bobbin 24. As seen in FIG. 6, a second conductive wire 34 preferably substantially overwraps the first conductive wire 32, the conductive foil 30, and the central portion 26 of the elastomeric bobbin 24. The second wire 34, however, is preferably wrapped around the central portion 26 of the bobbin 24 in a direction substantially perpendicular to the direction in which the foil 30 and the first wire 32 are wrapped. Both the first and second conductive wires 32 and 34 are preferably wrapped around the central portion 26 of the elastomeric bobbin 24 such that the wires 32 and 34 are maintained between adjacent pairs of the wing portions 28 of the elastomeric bobbin 24. The wing portions 28 prevent the wires 32 and 34 from sliding off the central portion 26 of the bobbin 24.

The first wire 32 and second wire 34 may be of a variety of cross-sections within the scope of the invention, but in the preferred embodiment, both wires 32 and 34 have substantially round cross-sections. Such round wires permit small, high pressure contact points between the wires. Although, not clearly shown in the drawings, these high pressure contacts occur at the intersections of the first and second wires. Thus, even a relatively small total mating force between the electronic components and connector will provide high pressure contacts due to the small area over which the total mating force is distributed between the first and second wire. Since the wires are preferably wrapped in more than one revolution around the bobbin 24 and foil 30, multiple electrically conductive pathways are formed from one end of the contact element 20 to the other. The multiple pathways provided by the wires and foil substantially increase the electrical conductivity or current carrying capacity of the contact elements 20.

The preferred embodiment of the invention, as described above, provides significant advantages over previous connectors for electrical components having land grid arrays. The contact elements have internal resilience provided by the elastomeric bobbin at the core of the contact member. Furthermore, the high pressure contact points and multiple pathways substantially enhance the performance of the contact elements individually and the connector cumulatively.

From the foregoing it will be appreciated that the invention provides a novel electrical connector for electrically connecting circuit components. The invention is not limited to the preferred embodiment described herein, or to any particular embodiment. Specific examples of alternative embodiments considered to be within the scope of the invention include embodiments where the elastomeric bobbin 24 is wrapped by the wires 32 and 34 without the conductive foil 30 underlying the first wire 32. Also, the invention contemplates the use of only the first wire 32 overlaying the foil 30, rather than both wires 32 and 34. Still another embodiment would utilize peaks on the top and bottom surfaces of the bobbin 24 to create the desired force concentration. Other modifications to the preferred embodiment may also be made within the scope of the invention.

The invention is defined by the following claims.

What is claimed is:

1. The electrical connector for electrically connecting first and second circuit components, said components each having an array of contact pads, said connector comprising:

a dielectric housing having substantially planar top and bottom surfaces and sidewalls connecting said top and bottom surfaces;

a plurality of substantially open receptacles in said housing; and a plurality of contact members individually disposed in distinct ones of said plurality of receptacles, said contact members extending above said top surface and below said bottom surface to contact respective ones of said contact pads of said first and second circuit components, said contact members including:

an elastomeric core;

a first electrically conductive wire wrapped around said core in a first direction; and a second electrically conductive wire wrapped around said core and said first wire in a second direction, said second wire contacting said first wire at a plurality of wire contact points to provide electrical connection between said first and second wires.

2. The electrical connector in accordance with claim 1 wherein said contact members further comprise an electrically conductive foil wrapped substantially in said first direction around said core, said foil being substantially interposed between said core and said first wire, and said second wire being wrapped in said second direction around said core, said foil, and said first wire.

3. The electrical connector in accordance with claim 1 wherein said second direction is substantially perpendicular to said first direction such that said wire contact points are formed by said first wire and said second wire making contact at approximately a right angle.

4. The electrical connector in accordance with claim 1 wherein said housing includes contact retainers to retain said contact members within said housing, said contact retainers including substantially triangular fillets within said receptacles for substantially retaining said contacts within said receptacles.

5. The electrical connector in accordance with claim 1 wherein said elastomeric core comprises a bobbin having a generally rectangular central body and four wings having mutually substantially parallel axes.

6. The electrical connector in accordance with claim 5 wherein said first and second wires are wrapped around said central body of said core between adjacent pairs of said wings.

7. An electrical connector for electrically connecting first and second circuit components, said components each having an array of contact elements thereon, said connector comprising:

a generally rectangular dielectric housing having top and bottom surfaces and walls connecting said top and bottom surfaces;

a plurality of substantially open receptacles in said housing, said plurality of receptacles being arranged in an array defining a plurality of rows of receptacles and a plurality of columns of receptacles, said rows and columns being generally perpendicular; and a plurality of individual contact members, each contact members being disposed in a distinct one of said plurality of receptacles, a portion of each said contact member extending above said top surface and a portion extending below said bottom surface to contact respective ones of said contact pads of said first and second circuit components, each said contact member including an elastomeric dielectric core and a first electrically conductive member wrapped in a plurality of turns around said core in a first direction.

8. The electrical connector in accordance with claim 7 wherein at least one of said housing and contact members include contact retainers to retain said contact members within said housing, said contact retainers including substantially triangular fillets within said receptacles for substantially retaining said contacts within said receptacles.

9. The electrical connector in accordance with claim 7 wherein said elastomeric dielectric core comprises a bobbin having a generally rectangular central body and four wings having mutually substantially parallel axes.

10. The electrical connector in accordance with claim 7 wherein said contact members further comprise an electrically conductive foil wrapped substantially in said first direction around said core, said foil being substantially interposed between said core and said first wire.

11. The electrical connector in accordance with claim 7 further comprising a second electrically conductive wire wrapped around said core and said first wire in a second direction, said second wire contacting said first wire at a plurality of wire contact points to provide electrical connection between said first and second wires.

12. The electrical connector in accordance with claim 11 wherein said second direction is substantially perpendicular to said first direction such that said wire contact points are formed by said first wire and said second wire making contact at approximately a right angle.

13. The electrical connector in accordance with claim 10 further comprising a second electrically conductive wire wrapped around said core, said foil and said first wire in a second direction, said second wire contacting said first wire at a plurality of wire contact points to provide electrical connection between said first and second wires.

14. The electrical connector in accordance with claim 13 wherein said second direction is substantially perpendicular to said first direction such that said wire contact points are formed by said first wire and said second wire making contact at approximately a right angle.

15. A contact for electrically connecting a contact pad of a first circuit to a contact pad of a second circuit, said contact comprising:

a dielectric core of elastomeric material to be compressed between said contact pads;

a first electrically conductive wire wrapped around said core in a first direction for providing an electrical path around said core; and a second electrically conductive wire wrapped around said core and said first wire in a second direction, said second wire making intersecting contact with said first wire at a plurality of wire contact points.

16. The contact in accordance with claim 15 further comprising an electrically conductive foil wrapped substantially in said first direction around said core, said foil being substantially interposed between said core and said first wire, and said second wire being wrapped in said second direction around said core, said foil, and said first wire.

17. The contact in accordance with claim 15 wherein said second direction is substantially perpendicular to said first direction such that said wire contact points are formed by said first wire and said second wire making intersecting contact at approximately a right angle.

18. A process for making an electrical connector for electrically connecting first and second circuits having a plurality of contact pads, said process comprising the steps of:

(a) providing a dielectric housing having substantially planar top and bottom surfaces and sidewalls, said housing having a plurality of substantially open receptacles having contact retainers disposed therein;

(b) providing an elastomeric bobbin;

(c) wrapping a first electrically conductive wire around said bobbin in a first direction;

(d) wrapping a second electrically conductive wire around said bobbin in a second direction with said second wire contacting said first wire at a plurality of wire contact points to provide electrical connection between said first and second wires; and (e) repeating steps (b) through (d) until a predetermined number of wire-wrapped bobbins have been assembled; and (f) inserting a plurality of wire-wrapped bobbins into said receptacles so as to be substantially held within said receptacles by said contact retainers.

19. The process in accordance with claim 18 further comprising the step of wrapping each of said plurality of bobbins with an electrically conductive foil in said first direction, said foil-wrapping step to be performed after said bobbin providing step and before said wire-wrapping steps such that said first wire-wrapping step wraps said first wire substantially over said foil.

20. The process in accordance with claim 18 wherein said second direction is substantially perpendicular to said first direction such that said wire contact points are formed by said first wire and said second wire making contact at approximately a right angle.

* * * * *